United States Patent [19]

Herzog

[11] 4,104,817

[45] * Aug. 8, 1978

[54] INVENTORY-CONTROL MERCHANDISE DISPLAY APPARATUS

[75] Inventor: Milton W. Herzog, Valley Stream, N.Y.

[73] Assignee: H. Goodman & Sons, Inc., Kearny, N.J.

[ * ] Notice: The portion of the term of this patent subsequent to Dec. 13, 1994, has been disclaimed.

[21] Appl. No.: 714,703

[22] Filed: Aug. 16, 1976

Related U.S. Application Data

[63] Continuation of Ser. No. 580,560, May 27, 1975.

[51] Int. Cl.[2] ..... A47F 5/00

[52] U.S. Cl. ..... 40/19.5; 211/59.1; 248/220.3

[58] Field of Search ..... 40/19.5, 124, 2 R, 20 R, 40/20 A, 19, 322, 128, 22, 334, 308, 316, 317, 331; 211/59.1, 54, 184; 248/220.3, 220.4, 221.1, 223; 402/70; 197/102

[56] References Cited

U.S. PATENT DOCUMENTS

| | | | |
|---|---|---|---|
| 1,277,211 | 8/1918 | Graham | 211/59 X |
| 1,486,983 | 3/1924 | McDonald | 40/19.5 X |
| 2,537,116 | 1/1951 | Aimes | 40/334 |
| 2,761,231 | 9/1956 | Hess | 40/19.5 |
| 3,645,485 | 2/1972 | Gold | 248/223 |
| 3,696,937 | 10/1972 | Braverman | 211/54 |

FOREIGN PATENT DOCUMENTS

| | | | |
|---|---|---|---|
| 162,103 | 1/1949 | Austria | 40/19.5 |
| 529,911 | 12/1940 | United Kingdom | 40/19.5 |

*Primary Examiner*—John F. Pitrelli

[57] ABSTRACT

Merchandise display apparatus here includes an upright support and a cantilever arm extending from the support. The arm bears demarcations distributed along its length to provide a measure of the amount of merchandise on the rod and a label at a portion of the arm remote from the support enabling the arm to be related to the merchandise on the arm. The transverse size of the arm all along its length including the demarcations and the label-bearing portion is limited so that the arm can readily enter a conventional opening in merchandise-bearing cards that are to be loaded onto and removed from the arm.

3 Claims, 13 Drawing Figures

FIG. 1
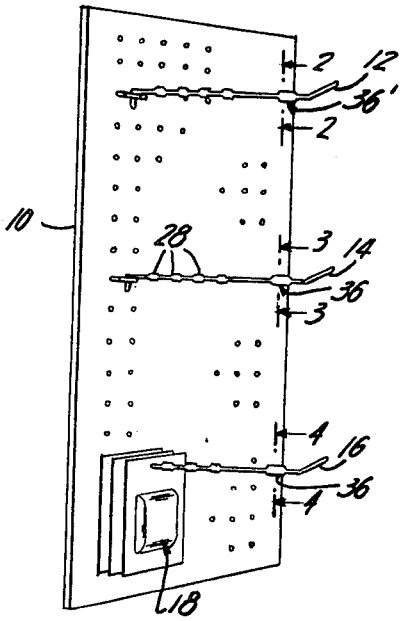
FIG. 7
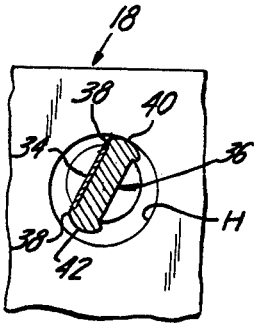
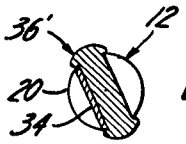
FIG. 2
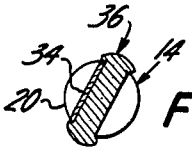
FIG. 3
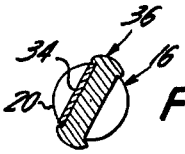
FIG. 4
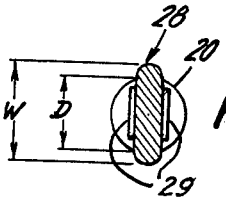
FIG. 6
FIG. 5
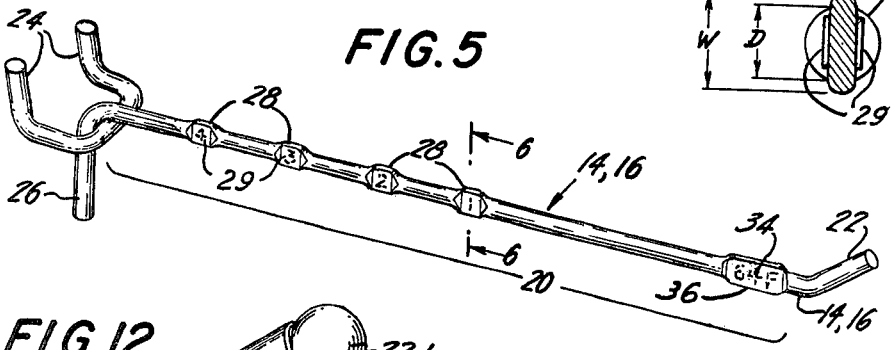
FIG. 12
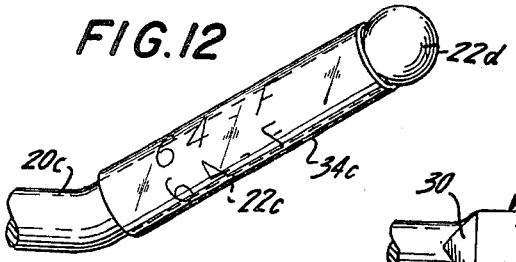
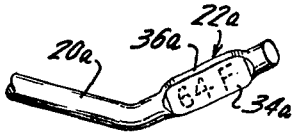
FIG. 9
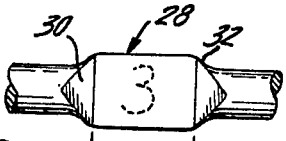
FIG. 8
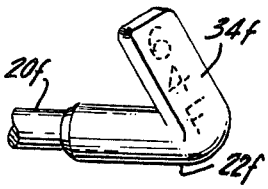
FIG. 13
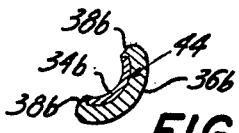
FIG. 11
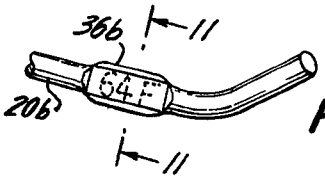
FIG. 10

INVENTORY-CONTROL MERCHANDISE DISPLAY APPARATUS

This is a continuation of application Ser. No. 580,560 filed May 27, 1975.

FIELD OF THE INVENTION

This invention relates to merchandise display apparatus, such as is widely used in retail stores.

BACKGROUND OF THE INVENTION

It is desirable for a retail merchant to be able to estimate quickly and record the amount of each item of merchandise on display for sale. It has long been known that the number of articles on a rod can be gauged quickly by scale markings along the rod. As an application of that arrangement, the amouunt of merchandise of the type that hangs from a cantilever arm can be quickly estimated by scale markings along the arm.

Separately, a label carried at the free end of a second arm parallel to a merchandise carrying arm has long been known, for providing information related to such merchandise. Varied information can be included on the label, such as its price and its brand, and the kind of product and its code designation may also be included. Such dual-armed merchandise display device tends to become relatively expensive, a significant concern where large numbers of such devices are needed. In addition, dual-arm display devices waste an undue amount of display area that can better be used for display of merchandise.

SUMMARY OF THE INVENTION

The present invention provides an arm extending cantilever fashion from a support for suspending packages of merchandise. Demarcations along the arm are variably concealed by merchandise on the arm, providing both a measure of the amount of merchandise on hand and a measure of depletion of the stock. Such information is useful in re-ordering and in routine taking of inventory. The same arm bears a label that is adapted to identify the merchandise on that arm. The label is located on a portion of the arm remote from its supported end. The portions of the arm carrying the label and the demarcations that provide a measure of the amount of merchandise on hand and the depleted amount, are of limited size transverse to the arm, small enough so the arm can readily enter a conventional small hole through the merchandise-bearing cards.

Further features of the invention relate to formations of the arm accommodating label characters of maximum size, consistent with the limitation of the transverse size of the arm, and various features aimed at protecting the label from potentially harmful rubbing by a merchandise-carrying card, and aimed at economically but effectively providing the amount-indicating demarcations along the arm. Still other novel features are present in the following detailed description of an illustrative embodiment of the invention and a few modifications.

The nature of the invention and its further novel features and advantages will be better appreciated from the following detailed description, shown in the accompanying drawings.

THE DRAWINGS

FIG. 1 is a perspective view of merchandise display apparatus embodying features of the invention, including a few merchandise-bearing cards.

FIGS. 2–4 are greatly enlarged cross-sections of the merchandise supporting rods of FIG. 1 at the planes 2—2, 3—3 and 4—4 in FIG. 1.

FIG. 5 is a perspective view of a merchandise supporting rod of FIG. 1, drawn to larger scale than in FIG. 1.

FIG. 6 is a greatly enlarged vertical cross-section of the rod shown in FIG. 5 as viewed at the plane 6—6 in FIG. 5.

FIG. 7 is a greatly enlarged cross-section of a display rod as in FIG. 4, together with a fragmentary illustration of a merchandise display card.

FIG. 8 is a greatly enlarged view of a portion of FIG. 5.

FIGS. 9 and 10 are fragmentary perspectives of modifications of FIG. 5.

FIG. 11 is a greatly enlarged cross-section of a rod as viewed at the plane 11—11 of FIG. 10.

FIGS. 12 and 13 are fragmentary perspectives of further modifications of FIG. 5.

THE ILLUSTRATIVE EMBODIMENTS

Referring now to the drawings, an upright support 10 is shown in FIG. 1, being in this instance a panel having a modular pattern of holes. Three brackets 12, 14 and 16 are shown in FIG. 1. Brackets 14 and 16 are identical, and differ from bracket 12 in one respect discussed below. A series of merchandise-bearing cards 18 hang from bracket 16, concealing part of its length.

Each bracket 14 and 16 in FIG. 6 includes an arm having an elongated portion 20 for carrying merchandise, conventional formations at one end of the arm for securing the bracket to support 10, and a free end portion 22 that slants upward. The securing means illustrated includes two prongs 24 that are bent upward to penetrate respective spaced-apart holes in panel 10, prongs 24 being formed of a bent rod that is welded to the arm. A leg 26 extends downward from the main arm and bears against the front of panel 10. Securing means 24, 26 causes the arm to extend in cantilever fashion, approximately horizontally, from its secured end at the panel to its free end portion 22.

The arm shown is made of a steel rod that is round in cross-section. There are four demarcations in the form of flattened portions 28 distributed at equal intervals along the arm. In an example, portions 28 are distributed at 1½-inch intervals, covering six inches of the arm nearest securing means 24, 26, and the arm is nine inches long. Flattened portions 28 in this example are numbered "1-2-3-4" as shown, forming a scale. Many packages may be suspended from portion 20. The rod enters a hole in each of a series of merchandise-bearing cards that are loaded successively onto the rod. Varying numbers of packages on portion 20 act to conceal a varying extent of the scale. The ascending numbers of the scale represent the extent of depletion of the stock. By like token, the scale provides a measure of the amount of merchandise remaining in inventory on the rod.

As seen in FIGS. 5 and 6, each flattened portion 28 has opposite faces that are flat and vertical. The term "flattening" is here used to mean providing a flat face or opposite flat faces by a swaging operation. Each of the portions 28 is formed by locally swaging the round rod between flat-faced dies having grooves to form the scale numerals 29 which thus project from the flat faces. The flattening operation causes some elongation of the rod and it produces a flattened portion whose width W is notably greater than the diameter D of the rod where it is round. The flattened portions raise bumps along the top and the bottom of the rod. The cross-sectional area of the flattened portions 28 is nearly as great as the round cross-section of rod 20. Width W in an example is about ¼ inch and the thickness in this example is about 3/32 inch, giving a cross-sectional area of portion 28 of about 0.0234 square inch as compared to a 3/16-inch diameter D and a cross-sectional area of about 0.0275 square inch of rod 20.

The flattened portions, with the resulting bumps that rise from the cylindrical surface of the essentially straight rod 20, have several attributes. Being wide, the flat faces can bear large easily read characters. However, the flat faces and related bumps can be noted where the light or the viewing angle is poor, by sliding one's hand along the portion of a rod that is not occupied by packages. The strength of the rod as a cantilever support is not impaired and may even be enhanced where (as in the illustrated form) the transversely enlarged dimension (diameter plus the bumps) is in the vertical or near-vertical plane.

In the example partly identified above by dimensions, the length L of each flat face is about ⅜ inch. Sloping end facets 30 provide transitions between the flat facets and the round rod sections. The bumps rise above the level of the aligned round rod sections by only 1/32 inch in the dimensioned example, but in any case there are rounded transitions 32 between the round and the flattened portions of the rod along the top and bottom surfaces of the rod at each end of each flattened portion, so that the presence of the flattened portions does not appreciably impede sliding of a merchandise-bearing card along rod 20.

Adjacent free end 22 of the cantilever arm there is a label 34, which here reads "64-F" to relate the rod to the merchandise that is allocated to that rod. Label 34 is of any suitable material. For example, it may be printed paper, especially paper with a coated or laminated transparent film, or embossed foil or the like. A wide variety of labels may be prepared on a single large sheet, the individual labels being die-cut for individual use and removably adhered to a carrier sheet. Many differently labeled rods can thus be made readily available at the point of use, and their identifying marks can be changed easily.

Label 34 is here applied to a flattened portion 36 of the rod, in this example having roughly the same width W as portions 28 but longer, e.g., ¾ inch. The flat label-bearing faces have marginal longitudinal ribs 38 (FIG. 7) flanking label 34. The labels 34 on flattened portions 36 of rods 14 and 16 slant upward to the right and the label 34 on flattened portion 36' slopes downward to the right, as shown in FIGS. 2, 3 and 4. The example shown involves a slope of about 22°, but of course the slant angle can be varied widely. Rod 12 is installed on support 10 above eye-level and rods 14 and 16 are installed near eye-level or below. The tilt of the labels makes it easier to read them in taking inventory. Here the tilt is about the axis of the rod.

As seen in FIG. 7, merchandise-bearing card 18 has a hole H that is conventionally round and has a diameter appreciably larger than the width W of the flattened sections 28 and 36 along the arms. This provides important width for larger characters at portions 28 and label 34. However, the transverse widths of the scale and label-bearing flattened portions of the rod are limited, small enough for readily entering the holes H of ordinary size in the merchandise-bearing cards.

The cards are guided by lower guide surface 42 and bearing surface 40 to move along rod 20 out of contact with the label. A corner is formed where the label-bearing face has an abrupt transition to the bearing and guide surfaces 40 and 42. Such corners are exaggerated where ribs 38 are present. These corners and especially these ribs enhance the effect of the curvature of hole H in guarding the label against threat of defacement or damage when merchandise cards are loaded on and removed from the rods. The corners would have some of this effect even if the label-bearing face were directed upward; but there is greater assurance of these corners protecting the label where (as shown) bearing surface 40 faces upward to provide support for the merchandise card. With this arrangement, random sidewise displacement of a card as it is shifted along the rod does not cause the edge of the hole to rub the label.

FIG. 9 illustrates two modified aspects of the flattened label-bearing portion of the rod, for the most part having the same details and advantages as the flattened portions 36 and 36'. First, the flattened label-bearing portion **36*a* is formed along slanting end portion 22*a* of rod 20*a*. The remainder of the rod (not shown) includes portions 24, 26 and 28. Second, the opposite faces of the flattened portion are at least approximately parallel and vertical. Locating the flattened label-bearing portion of the rod along end 22 allows utilization of the horizontal portion of rod 20 for packages without concealing the label. Separately, the vertical disposition of opposite faces of flattened portion 36*a* provides surfaces to which two labels 34*a*** are adhered, in position for inspection from either side of the rod.

It is apparent that flattened portions 36 and 36' can be modified to have opposite vertical faces with attendant advantages. Additionally, it will be recognized that flattened portion **36*a* on end portion 22*a* can slant as shown in FIGS. 2 and 3**, with corresponding advantages. In all cases, relatively broad label-bearing faces are provided on flattened portions of the rods, which readily enter holes H of the package cards and which guard the labels against the package causing defacement or other damage during shift of the merchandise along the rods.

FIGS. 10 and 11 show a further modification of the label-bearing portion of the rod. Portion **36*b* has a prominently concave face 44 and overhanging longitudinal lips 38*b*, formed integrally by successive forming operations. Label 34*b* is a resilient member, especially a clear plastic strip with imprinted characters, or characters imprinted on or provided separately at the rear face of a clear plastic member. The feature of a protective clear plastic cover (see above) can be incorporated in labels 34, but the concave configuration of FIGS. 10 and 11 and overhanging lips 38*b* provide still greater protection for the label. The mechanical working of the rod to provide this configuration increases the cost, making the construction of FIGS. 10 and 11 less attractive in this respect than that of FIGS. 2–9**.

FIG. 12 shows a further modification. Rod **20*c* has a round portion 22*c* and an up-set or enlarged tip 22*d* such as a ball of greater diameter than portion 22*c* of the rod. A label may be embossed into a plastic sleeve 34*c*** and the sleeve then forced into place past ball formation 22*d*. Several repetitions of the label indicia are included around the tube, for easy viewing and to avoid concern as to the orientation of the characters when the sleeve is being applied. The repeated characters of label 34*c* are ordinarily smaller and thus less easily read than in the case of labels 34 and 34*a*. Alternatively, a label can be adhered to and wrapped around the rod and a protective sleeve of clear plastic can be forced into position covering the label.

A further modification is illustrated in FIG. 13. Rod 20*f* has a straight end to which a fitting 22*f* of metal or plastic is attached, as by adhesive or force-fit. Label 34*f* is formed on, or attached to, an upstanding portion of fitting 22*f*, even (as shown) a portion of fitting 22*f* that slants upward and reversely toward the support end of the bracket. Label 34*f* is readily viewed from the end of the bracket. Being flat and bounded by corners, it has the feature of inherent self-protection from harmful rubbing contact with the edges of hole H. The same shape of label-bearing portion 34*f* can be formed as an integral part of rod 20, by swaging. As a further alternative, the length of label-bearing portion 34*f* may extend horizontally at any other angle with the label-bearing facet in a plane which is perpendicular to arm portion 20*f* or which slants upward and toward the rear, i.e., the support end of the arm.

The term "flat" is not to be treated in the strict geometric sense, since departures from the "flat" including concave or even moderately convex faces can serve like purposes. Flat and equivalent faces can be called "facets". Rods of square or other cross-section can similarly be swaged on one facet or opposite facets to provide the scale demarcations and associated bumps. One or both of the lateral surfaces of portions 28 and 36 of rods that are round could of course be made merely flat as by grinding. In that case, the localized flat portions could be felt in cases where the visibility is poor, but the extra width for scale numerals and the readily-felt bumps that result from flattening the rod by swaging would be missing. Indeed, if the advantage of being able to feel the scale demarcations were not valued, the rod could have a flat or flattened face along its whole length, bearing scale marks and an applied label. Such rod could have label-protecting corners or ribs (see ribs 38) all along its length.

The feature of protection for the label afforded by the longitudinally extending corners on slant portions 36 and 36' of arms 12, 14 and 16, as well as portion 36*b*, described above, is not limited to use with merchandise cards which commonly have round holes. Where the merchandise card has a hole or slot of other shape, for example a square or rectangular hole with its top and bottom edges horizontal, and with its side edges vertical, it can be seen that the slanted facets of FIGS. 2, 3 and 4 and the concave facet of FIGS, 10 and 11 are immune from any likelihood of rubbing or damage to a label on the facet when merchandise cards are shifted along the arm. Similarly, label-bearing facets are effectively disposed in a vertical plane where a merchandise card has a hole shaped as an equilateral triangle with an apex at the top.

While the arms as described above are of steel or other suitable metal, arms of like construction can be molded of reinforced plastic as a modification. Various further modifications will occur to those skilled in the art, and consequently the invention should be construed broadly in accordance with its full spirit and scope.

What is claimed is:

1. Merchandise display apparatus adapted for use in an inventory control system, including a support, and a metal rod of essentially uniform cross-section at least along most of its length, said rod having at one end thereof means for securing the rod to the support so that the rod projects in cantilever fashion with a free end of the rod exposed and said free end being no more than moderately larger transversely than the maximum transverse dimension of said essentially uniform cross-section of the rod for readily entering holes in a series of merchandise-bearing cards, said rod having plural swaged portions having facets and associated bumps distributed along the rod for providing a measure of the quantity of merchandise-bearing cards on the rod, any one or more of the facets and associated bumps that are not concealed by merchandise-bearing cards being readily recognized by feel in the course of taking inventory, said facets bearing a sequence of characters distributed along the rod the rod having rounded transitions between each bump and the adjoining portions of the rod for facilitating the movement of merchandise-bearing cards along the rod.

2. Merchandise display apparatus in accordance with claim 1, wherein said swaged portions have essentially vertical opposite facets whereby the vertical widths of the swaged facets are greater than the vertical dimension of the rod between the swaged facets and contribute to the strength of the rod.

3. Merchandise display apparatus in accordance with claim 1, wherein said rod is of round cross-section between said swaged facets and wherein the cross-sectional area of the rod at said swaged facets is nearly the same as that of the round cross-section.

* * * * *